United States Patent [19]

Igelmund

[11] Patent Number: 4,843,848

[45] Date of Patent: Jul. 4, 1989

[54] OFFICE EQUIPMENT HOLDER

[76] Inventor: Darrell A. Igelmund, 3602 Lake Washington Blvd. N., Renton, Wash. 98056

[21] Appl. No.: 118,652

[22] Filed: Nov. 9, 1987

[51] Int. Cl.[4] ..... E05B 73/00

[52] U.S. Cl. ..... 70/58; 70/18

[58] Field of Search ..... 70/57, 58, 18, 14, 417; 248/205.3; 156/60

[56] References Cited

U.S. PATENT DOCUMENTS 4,733,840 3/1988 D'Amora ..... 70/58

*Primary Examiner*—Robert L. Wolfe

[57] ABSTRACT

A fixture for securing office equipment and the like comprising an adhesive plate 10 that bonds to the office equipment and a belt 18 and a locking means such that the belt 18 protects the adhesive plate 10 from being pried from the office equipment. The locking mechanism can be a mating pin 23 and padlock 26. The fixture can be secured to a fixed location by a steel tether cable 27, bonded to a work surface by adhesive or mechanically fastened to a work surface by screws.

8 Claims, 2 Drawing Sheets

OFFICE EQUIPMENT HOLDER

BACKGROUND

1. Field of Invention

This invention relates to adhesive fixtures, especially for use in tethering, positioning and securing objects with adhesive.

2. Description Of Prior Art

Because of the risk of theft to personal computers, typewriters, video cassette recorders, and other expensive and reasonably portable devices, consumers have resorted to a variety of methods to secure them from theft.

Many of these devices use adhesive as the fastening mechanism instead of bolts, rivets, or other mechanical means. Adhesive products are popular because they require no special tools or skills to install. Plus, unlike bolts, screws and rivets, the use of adhesive does not require any permanent modifications such as holes to be made to the equipment being secured.

One such adhesive fixture uses a steel cable as the principal anchoring method. One end of the cable is secured to a desk (by wrapping the cable around a leg, etc.), and the other end is terminated to a metal plate that carries the adhesive. This adhesive plate is pressed into place on to the equipment to be secured, and the bond that forms between the metal plate and the equipment acts as the fastener that ties the steel cable to the equipment. Users like the ease of use of this fastener, the latitude the cable gives them to readjust the position of the equipment, and the ability to unlock the cable and move the equipment should it be required. Most users have found, however, that the adhesive does not provide meaningful security. The dissatisfaction is caused by the technical properties of the adhesive. The adhesive is very strong if the cable is pulled in a plane parallel to the plate. The adhesive is moderately strong if pulled perpendicular to the plane of the plate. And, the adhesive is very weak if the plate is pried (cleavage mode). In other words, the plate appears very strong to the pull, but if the thief pries the plate it can be removed quite easily.

Another such adhesive fixture attempts to correct for the above situation by using an extremely large piece of adhesive. This large size limits the positioning of the adhesive plate to the bottom of the equipment to be secured. Another similarly large plate is bonded to the desktop when the equipment is to be placed. The plates are then locked together with a special locking mechanism. Users have found that, although this method is stronger than the smaller plate/cable fastener, the equipment is impossible to reposition for user comfort and requires special tools and skills when the equipment needs to be relocated.

Another such device is a steel box into which the equipment is placed. The box is bonded to the surface of the desk with large pieces of adhesive and access to the user portion of the office equipment is controlled by lockable, hinged surfaces. This device suffers all of the problems of the above large plate device and in addition greatly detracts from the appearance of the office environment.

Most users, therefore, would find it desirable to have a security fixture that provided easy positioning of the equipment for user comfort; allowed for relocation of the equipment without requiring special tools or skills; did not substantially detract from the looks of the equipment; and offered the non-destructive and ease of use features of adhesive without risking the dangers of easy prying of the fixture from the equipment.

OBJECTS AND ADVANTAGES

Accordingly, I claim the following as my objects and advantages of the invention: to provide a fixture that secures office equipment from theft that requires no special skill to install, to provide a fixture that allows the equipment to be secured without drilling holes or modifying the equipment in any way that might void the warranty, to provide a fixture that allows the equipment to be repositioned on the work surface easily and to be relocated quickly, to provide a fixture that does not shroud the unit being protected in a box for security, and to provide a fixture that uses adhesive in such a way as to render it tamperproof from prying.

Readers will find further objects and advantages of the invention from a consideration of the ensuing description and accompanying drawing.

DRAWING FIGURES

DRAWING REFERENCE NUMERALS

Figure 1:
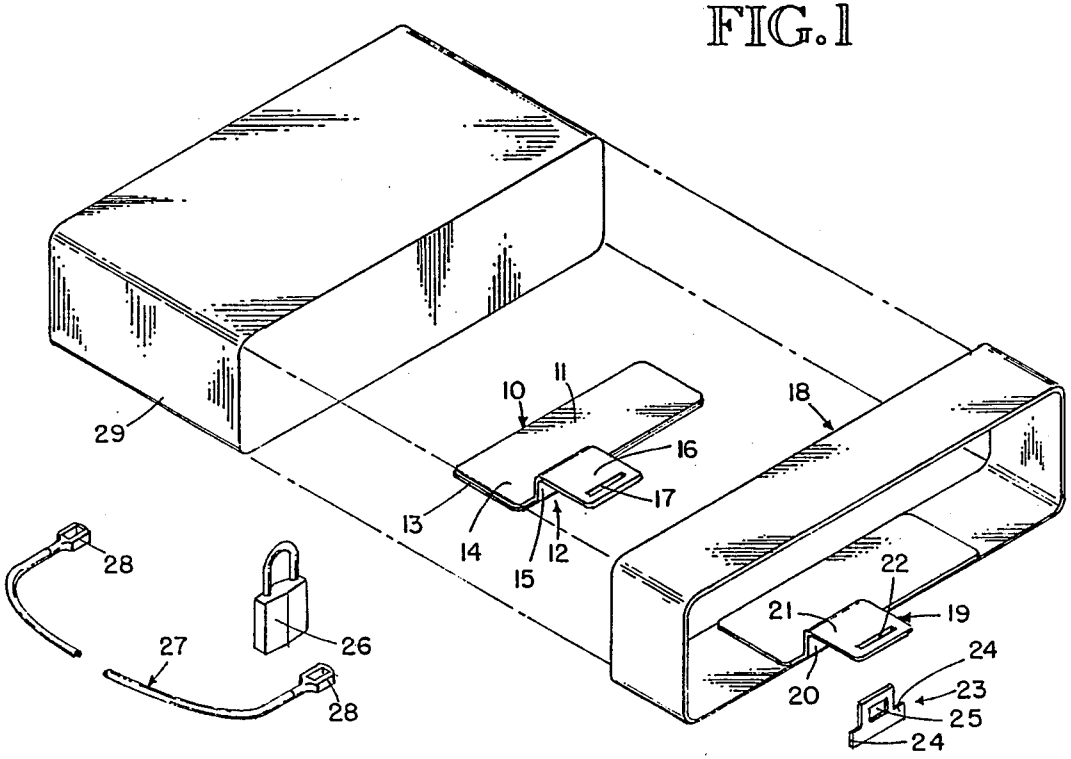
FIG. 1 shows a perspective exploded view of an adhesive fixture according to the invention and its relationship to an object to be secured (personal computer).

10 adhesive plate
11 bonding area of 10
12 adhesive plate flange of 10
13 double sided adhesive
14 adhesive liner of 13
15 adhesive plate stop of 12
16 locking portion of 12
17 adhesive plate flange mating pin slot of 16
18 belt
19 belt flange of 18
20 belt flange stop of 19
21 locking portion of 19
22 belt flange mating pin slot of 21
23 mating pin
24 mating pin ears of 23
25 padlock slot of 23
26 padlock
27 tether cable
28 end fittings of 27
29 personal computer
30 table

ADHESIVE FIXTURE - DESCRIPTION

FIG. 1 shows an adhesive fixture according to the preferred embodiment of the invention and its relationship to a typical piece of office equipment to be secured (personal computer 29). The adhesive fixture comprises 5 units: The adhesive plate 10; belt 18; mating pin 23; padlock 26; and tether cable 27. The adhesive plate 10, belt 18, mating pin 23, and padlock 26 are preferably made of steel. The tether cable 17 is preferably made of stranded steel.

The adhesive plate 10 comprises an approximately 3"×10" bonding area 11 where one side of the double sided adhesive 13 is bonded. Extending vertically and away from the back edge of the bonding area 11 is an approximately 3" wide adhesive plate flange 12. The adhesive plate flange 12, comprises an approximately 1" long, substantially vertical component called the adhesive plate stop 15 and an approximately 3" long, substantially horizontal component called the locking portion 16. An approximately 2" wide adhesive plate mating pin slot 17 is located toward the back of the locking portion 16 of the adhesive plate flange 12.

The belt 18 comprises a fixture shaped such that it corresponds to the shape of the office equipment it is protecting. In this case, it is shaped such to fit over the back of a personal computer 29. The belt 18 as shown in FIG. 1 is approximately 4" wide, 20" long, and 6" tall. Extending vertically and away from the bottom, back edge of the belt 18 is an approximately 3" wide belt flange 19. The belt flange 19 comprises an approximately 1" long, substantially vertical component called the belt flange stop 20 and an approximately 3" long, substantially horizontal component called the locking portion 21. An approximately 2" wide belt flange mating pin slot 22 is located toward the back of the locking portion 21 of the belt flange 19.

The mating pin 23 comprises an approximately 2"×2" unit shaped such that one end can pass through the adhesive plate flange mating pin slot 17 and the belt flange mating pin slot 22. This is accomplished by the use of mating pin ears 24. The padlock slot 25 is an approximately ½"×1" slot positioned toward the center of the mating pin 23.

The padlock 26 is of commercially available manufacture. In this case, a ¼" shackle unit.

The tether cable 27 comprises approximately 5' of 7×19 format ¼" steel cable with metal end fitting 28 swaged on each side of the tether cable.

ADHESIVE FIXTURE - OPERATION/THEORY OF OPERATION

Adhesive is very popular holding medium in applications where drilling holes for mechanical fasteners is either not practical or desirable. The easiest to use form of adhesives are known as "Pressure Sensitive Adhesives" (PSA) such as your standard houshold tape. For appliations where it is desirable to have adhesive in between the two objects to be joined, "double sided pressure sensitive adhesive" is available. Examples of this are "carpet tape" and tape for holding pictures to a wall.

The invention shown in FIG. 1 uses double sided PSA as its fastening mechanism. And, it uses it in such a way as to maximize the holding power of the adhesive. In order to understand how this is done, it is necessary to understand the strengths and weaknesses of adhesives.

Imagine that you have joined two flat metal plates together with double sided PSA and you wish to separate them. Applying pressure in opposite directions, perpendicular to the adhesive ("pulling the plates apart") would be difficult. This is termed applying pressure to the adhesive in the "tensile mode". Applying pressure in opposite directions parallel to the adhesive ("sliding the plates apart"- "shearmode") would take at least ten times the force as "pulling them apart" because the bond provided by typical PSA's is at least ten times stronger in "shearmode" than it is in "tensile mode". The easiest way to take the example plates apart is to "pry" them apart. When prying you are not applying force uniformly across the plates perpendicular to the adhesive. Instead, you are applying force non-uniformly across the adhesive (e.g. the adhesive closest to the prying tool is most affected).

The invention shown in FIG. 1 only allows the adhesive to be pulled in the "shear mode"- the strongest holding mode of an adhesive due to the unique interaction of the adhesive plate 10 with the belt 18. It should be noted that even though the embodiment of this invention deals with double sided PSAs, the invention maximizes the holding power of adhesive regardless of the kind of adhesive used.

To attach the adhesive fixture shown in FIG. 1 to the personal computer 29 shown in FIG. 1, the user first removes the adhesive liner 14 to expose the double sided adhesive 13 that is bonded to the bonding area 11 of the adhesive plate 10. Next, the adhesive plate 10 is bonded to the bottom of the personal computer 29 by positioning the adhesive plate stop 15 such that it presses up to the back of personal computer 29, and then pushing upward such that the adhesive plate 10 bonds to the bottom of the personal computer 29. The results of this operation can be seen in FIG. 2 where the hidden lines shown the positin of adhesive plate 10 in relation to the pesonal computer 29.

The belt 18, shown in FIG. 1, can now be slid over the adhesive plate 10 and the personal computer 29. When positioned correctly, the adhesive plate flange 12 will overlap the belt flange 19 such that the adhesive plate flange mating pin slot 17 is aligned with the belt flange mating pin slot 22. The narrow portion of the mating pin 23 can now be inserted either upward or downward through the adhesive plate flange mating pin slot 17 and the belt flange mating pin slot 22.

The mating pin 23 is held in place by locking the padlock 26 through the padlock slot 25. The tether cable 27 is attached by locking an end fitting 28 to the same padlock 26.

Figure 2:
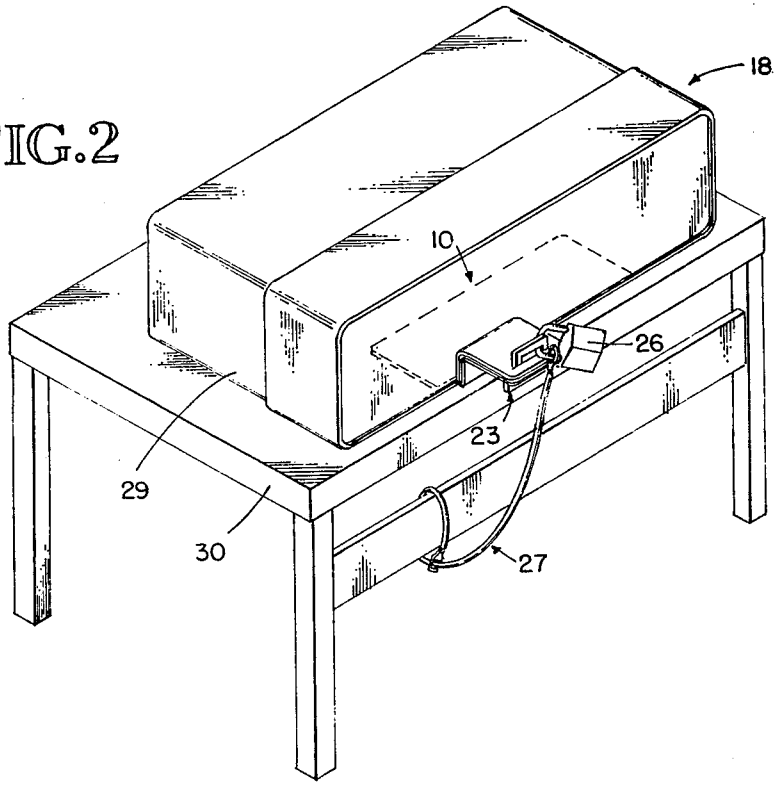
FIG. 2 shows a perspective view of such adhesive fixture attached to a personal computer with a steel tethering cable securing the units to a table.

To secure the unit, the other end of the tether cable 27 can be wrapped around a member of table 30 before locking it to the adhesive fixture as shown in FIG. 2.

FIG. 2 shows an assembled adhesive fixture with the belt 18 locked to the adhesive plate 10 via the mating pin 23 and the padlock 26. The personal computer 29 is now secure with all of the objects and advantages claimed.

By using a tether cable 27 of sufficient length, the user of the personal computer 29 will be allowed to readjust the location of the equipment for personal comfort.

The user will also find that the invention in no way requires the user to change his or her normal work pattern. No key is required to be carried to unlock any security panels or doors before usage as in the case of a metal security box.

The user will also find that the protection is provided by the adhesive plate 10 is uncommonly strong because it is protected from prying by the belt 18.

Should the equipment need to be relocated, all that is necessary is for the padlock 26 to be unlocked; the mating pin 23 removed and the equipment slid out from the belt 18.

I have described the process of installing the adhesive fixture in some detail and it should be noted that in practice, I have found the unit can be installed on a personal computer in less than a minute.

While the above description contains many specifications, the reader should not construe these as limitations on the scope of the invention, but merely as exemplifications of preferred embodiments thereof. Those skilled in the art will envision many possible variations are within its scope. For example, skilled artisans will be able to change the dimensions and shapes of the various embodiments. They will also be able to make the adhesive fixture out of alternative materials such as plastics and wood. They will be able to make many variations of the locking mechanism holding the adhesive plate and belt in position. They will be able to devise methods to secure the adhesive fixture to a fixed location by using mechanical methods like screws or by bonding the fixture to the work surface using adhesive. Accordingly, the reader is requested to determine the scope of the invention by the appended claims and through legal equivalents, and not by the examples which have been given.

I claim:

1. An adhesive fixture for securing objects comprising:

a plate bonded with adhesive to the object to be secured, a belt that covers and thereby protects said plate from being pried from said object, a means of securing said plate and associated said object to a fixed location.

2. The adhesive fixture of claim 1 where said plate is made of metal.

3. The adhesive fixture of claim 2 wherein said plate is comprised of a flat bonding area and a flange that protrudes out from said object.

4. The adhesive fixture of claim 1 wherein said belt includes a means to lock the position of said belt in relation to said plate.

5. The adhesive fixture of claim 4 wherein said belt is made of metal.

6. The adhesive fixture of claim 4 wherein said means comprises a flange that protrudes out from said belt so as to mate with like said flange of said plate and a means of locking flanges together.

7. The adhesive fixture of claim 6 wherein means comprises padlocking the said plate flange to the said belt flange.

8. The adhesive fixture of claim 1 wherein said means comprises bonding with adhesive the said adhesive fixture to a secure object such as a desktop or tethering said adhesive fixture with a wire rope with one end tied to a secure object such as a desk vanity panel and the other end tied to the said padlock.

* * * * *